US005513958A

United States Patent [19]

Mientus

[11] Patent Number: 5,513,958

[45] Date of Patent: May 7, 1996

[54] ACCUMULATOR CHARGING VALVE

[75] Inventor: Michael J. Mientus, Channahon, Ill.

[73] Assignee: Caterpillar Inc., Peoria, Ill.

[21] Appl. No.: 237,536

[22] Filed: May 3, 1994

[51] Int. Cl.[6] ..... F04B 49/08

[52] U.S. Cl. ..... 417/213; 60/452; 137/116

[58] Field of Search ..... 137/115, 116; 60/452; 417/213

[56] References Cited

U.S. PATENT DOCUMENTS

| | | | |
|---|---|---|---|
| 3,024,732 | 3/1962 | Nyman | 137/116 |
| 3,329,153 | 7/1967 | Henry-Biabaud | 137/116 |
| 3,570,519 | 3/1971 | Bianchetta | 137/101 |
| 4,114,637 | 9/1978 | Johnson | 137/116 |
| 4,173,866 | 11/1979 | Farr | 137/115 X |
| 4,665,697 | 5/1987 | Dantlgraber | 60/452 X |
| 4,699,571 | 10/1987 | Bartholomäus | 417/213 |

OTHER PUBLICATIONS

Article "17 Series Hydraulic Unloading Relief Valves" by United Technologies Automotive, A–4.01 published Jan. 1, 1990.

Article "Pressure Unloading Valve" M1A125, M1B125, by Sterling Hydraulics Limited, Drg. No. Asv 010802.

Article—"Differential Area Unloading Relief Valve", series RU101, by Parker Hannifin Corporation, pp. 35–36.

*Primary Examiner*—Stephen M. Hepperle

*Attorney, Agent, or Firm*—John W. Grant

[57] ABSTRACT

An accumulator charging valve has a first valve spool determining a cut-in pressure level at which fluid from a pump is directed to an accumulator and a second valve spool determining the cut-out pressure level at which fluid is no longer directed to the accumulator. When the pressure at the accumulator reaches a predetermined high level, the second valve spool moves to a position communicating an inlet port with an intermediate passage. The first spool is normally at a position blocking the intermediate passage from an outlet port so that a flow path is established through a pair of orifices reducing the pressure in the intermediate passage and the inlet port. The reduced pressure is transmitted to an actuating chamber to hold the second valve spool in the above noted position and to a pump displacement controller to destroke the pump to a low standby pressure displacement. When the pressure at the accumulator drops to a predetermined low level, the first valve spool moves to a position communicating the intermediate passage with the outlet port venting the actuating chamber so that the second valve spool moves to a position blocking the inlet port from the intermediate passage. This increases the pressure directed to the displacement controller upstroking the pump to a high pressure displacement. The cycle is repeated when the pressure reaches the predetermined high level.

8 Claims, 1 Drawing Sheet

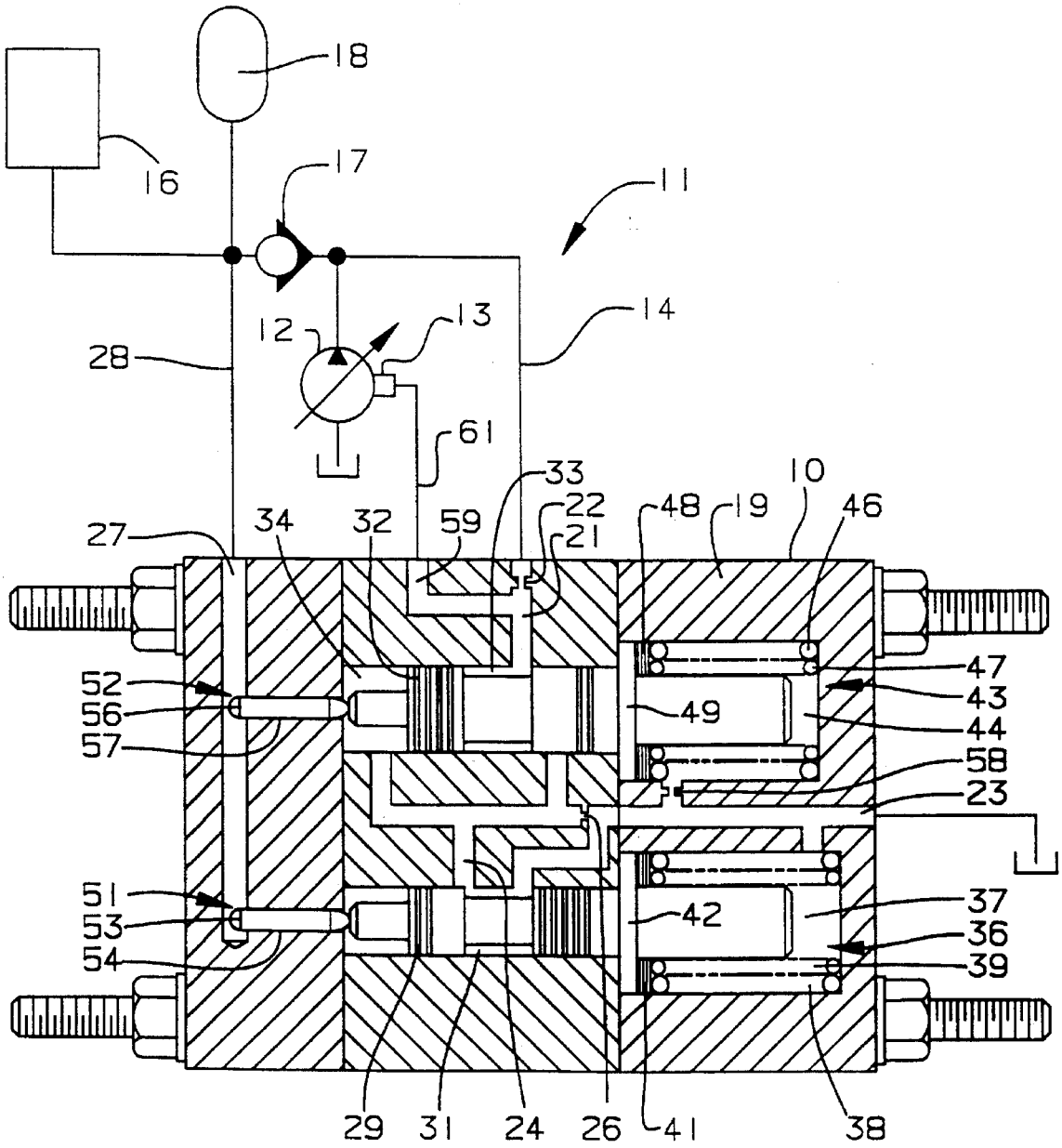
18
16
17
11
12
13
14
28
61
33
10
22
48
19
46
27
34
32
59
21
47
52
43
56
49
44
57
58
23
51
37
53
42
36
54
39
29
31
24
26
41
38

ACCUMULATOR CHARGING VALVE

TECHNICAL FIELD

This invention relates generally to a closed center hydraulic system having an accumulator therein and more specifically to an accumulator charging valve integrated within the system.

BACKGROUND ART

Many hydraulic systems such as steering and brake systems have accumulators incorporated therein to provide a source of pressurized fluid to supplement the output of the pump when the pump is unable to supply the needed volume of fluid for operating the system. Such systems commonly have an accumulator charging valve (sometimes called unloader valves) to maintain the pressure level of the fluid within a predetermined range under normal operating conditions. The accumulator charging valves typically increase flow from the pump to the system when the pressure level drops below a predetermined low cut-in pressure level and reduces flow from the pump to the system when the pressure level reaches a predetermined high cut-out pressure level.

The commercially available accumulator charging valves typically have a differential area for regulating the cut-in and cut-out pressure levels. Those accumulator charging valves use poppet type flow regulation in which a conical shaped popper valve engages a valve seat. The design constraints of some hydraulic systems require a 90 percent area ratio such that the differential area is very small. One of the problems encountered therewith is that the contact areas are subjected to high stresses resulting in deformation of the contact area. Since the differential area is very small, such deformation changes the area ratio enough to change one or both of the cut-in and cut-out pressure levels.

Another type of accumulator charging valve is disclosed in U.S. Pat. No. 3,570,519. That accumulator charging valve is specifically described as being integrated into a common valve with a flow control and relief valve and appears to be limited to an open center circuit or a fixed displacement pump.

Thus, it would be desirable to have an accumulator charging valve which does not use poppet type flow regulation thereby eliminating the high stress contact area, is very stable when making the shift at the cut-in and cut-out settings and has independent adjustability for cut-in and cut-out pressure levels. Another desirable feature is that the accumulator charging valve be operational with a variable displacement pump such that the pump destrokes to a minimum displacement setting when the high pressure cut-out setting is reached and increases the displacement when the low pressure cut-in setting is achieved.

DISCLOSURE OF THE INVENTION

In one aspect of the present invention, an accumulator charging valve comprises a body having an inlet port, an orifice provided in the inlet port, an outlet port, an intermediate passage, and an orifice communicating the inlet passage with the outlet port. A first valve spool slidably disposed in the body has a first position establishing communication between the intermediate passage and the outlet port and a second position blocking communication between the intermediate passage and the outlet port. A second valve spool slidably disposed in the body has a first position blocking the inlet port from the intermediate passage and a second position establishing communication between the inlet port and the intermediate passage. A first spring device resiliently biases the first valve spool to the first position and has a predetermined preload therein when the first valve spool is at the first position. A second spring means resiliently biases the second valve spool to its first position and has a predetermined preload therein when the second valve spool is at the first position. A first piston means moves the first valve spool to its second position when the fluid pressure in a control port reaches a first predetermined level. A second piston means moves the second valve spool to its second position when the fluid pressure in the control port reaches a second predetermined level which is higher than the first predetermined level. An actuating chamber defined at one end of the second valve spool is in continuous communication with the intermediate passage.

BRIEF DESCRIPTION OF THE DRAWINGS

The sole FIGURE is a combined schematic and diagrammatic illustration of an embodiment of the present invention.

BEST MODE FOR CARRYING OUT THE INVENTION

Referring to the drawing, an accumulator charging valve 10 is incorporated within a closed center hydraulic system 11. The hydraulic system includes a variable displacement hydraulic pump 12 having a pressure responsive displacement controller 13 for adjusting the displacement of the pump between a minimum displacement, low pressure stand-by position and a high pressure displacement position. A supply conduit 14 connects the hydraulic pump 12 to a steering circuit 16 through a check valve 17. An accumulator 18 is connected to the supply conduit 14 between the check valve and the steering system.

The accumulator charging valve includes a composite body 19 having an inlet port 21 connected to the supply conduit 14, an orifice 22 disposed within the inlet port 21, an outlet port 23, an intermediate passage 24, an orifice 26 connecting the intermediate passage 24 with the outlet port 23 and a control port 27 connected to the supply conduit 14 downstream of the check valve through a control line 28. A valve spool 29 is slidably disposed within a bore 31 in the valve body and has a first position establishing communication between the intermediate passage 24 and the outlet port 23 and a second position blocking the intermediate passage from the outlet port. Another valve spool 32 is slidably disposed within a bore 33 in the valve body and has a first position blocking the inlet passage 21 from the intermediate passage 24 and a second position establishing communication between the inlet port and the intermediate passage. An actuating chamber 34 is defined at one end of the valve spool 32 and is in continuous communication with the intermediate passage 24.

A spring device 36 resiliently biases the valve spool 29 to its first position and has a predetermined preload therein when the valve spool 29 is at the first position. The spring device 36 is disposed within a spring chamber 37 formed in the body and concentric with the bore 31. The spring device 36 includes a pair of coil compression springs 38,39 and one or more adjustment shims 41 disposed between the springs and a flange 42 connected to the valve spool 29. The flange 42 abuts against the body to define the first position of the valve spool 29.

Similarly, another spring device 43 resiliently biases the valve spool 32 to its first position and has a predetermined preload therein when the valve spool is at the second position. The spring device 43 is disposed within a spring chamber 44 in the body concentric with the bore 33 and includes a pair of concentric compression coil springs 46,47, one or more shims 48 disposed between the springs 46,47 and a flange 49 connected to the spool 32. In this embodiment, the flanges 32,49 are formed as integral parts of the respective valve spools 29,32.

A piston means 51 is provided for moving the valve spool 29 to its second position when the fluid pressure in the control port 27 reaches a first predetermined level hereinafter referred to as the cut-in pressure level. Similarly, another piston means 52 is provided for moving the valve spool 32 to its second position when the fluid pressure in the control port 27 reaches a second predetermined level which is higher than the first predetermined level. The second predetermined level is hereinafter referred to as the cut-out pressure level. The piston means 51 includes a piston 53 slidably disposed within a bore 54 for abutment with the valve spool 29. The piston means 52 similarly includes a piston 56 slidably disposed within a bore 57 in the body for abutment with the valve spool 32. In this embodiment, the diameter of the pistons 53,56 are equal and the preload of the spring device 43 is greater than the preload of the spring device 36.

A dampening orifice 58 communicates the spring chamber 44 with the outlet port 23. A signal port 59 communicates the outlet port 21 downstream of the orifice 22 with the displacement controller 13 through a signal line 61.

Industrial Applicability

In use, the cut-in pressure level is determined by the spring device 36 while the cut-out pressure level is determined by the spring device 43. The valve spools 29,32 are shown in the position they would occupy when the hydraulic system 11 is shut down. Upon start up of the system, the inlet port 21 is blocked from the intermediate passage 24 such that fluid from the supply conduit 14 passes through the orifice 22 to the displacement controller 13. With the steering circuit 16 at a neutral flow blocking position, fluid pressure is immediately generated in the supply conduit and is transmitted to the displacement controller causing the pump to upstroke to its high pressure displacement position to fill the accumulator 18. The fluid pressure in the supply conduit is also transmitted to the control port 27 where it acts on the pistons 53,56. When the fluid pressure in the supply conduit reaches the cut-in pressure level, for example 20,000 kPa, the force exerted by the piston 53 is sufficient to move the valve spool 29 rightwardly to its second position blocking the intermediate passage 24 from the outlet port 23. With the spool 32 in the first position, there is no immediate effect upon the system. However, when the pressure in the supply conduit reaches the cut-out pressure level, for example 21,500 kPa, the valve spool 32 is moved rightwardly to its second position establishing a flow path from the supply conduit 14 to the outlet port 23. The rightward movement of the valve spool 32 is dampened by restricting the flow of fluid exhausted from the chamber 44 through the orifice 58. The fluid flowing through the orifices 22 and 26 generates a pressure drop such that the fluid pressure in the inlet port 21 downstream of the orifice 22 and in the intermediate passage 24 upstream of the orifice 26 is at a substantially equal reduced pressure level. The reduced pressure is transmitted to the displacement controller 13 causing the pump 12 to destroke to its minimum displacement position. The reduced pressure is also transmitted to the actuating chamber 34 where it acts on the valve spool 32 to maintain it in its second position when the fluid pressure in the supply conduit 14 upstream of the check valve 17 drops to the low stand by pressure level of the pump 12.

Assume now that the steering circuit 16 is operated so that the fluid pressure in the supply conduit 14 downstream of the check valve 17 starts to drop. Initially both valve spools will remain in their second positions until the fluid pressure in the control port 27 reaches the cut-in pressure level. When this happens, the spring device 36 moves the valve spool 29 leftwardly to its first operating position to again communicate the intermediate passage 24 directly with the outlet port 23 thereby drastically reducing the pressure level in the intermediate passage 24, the inlet port 21 downstream of the orifice 22 and the signal port 59. The spring device 43 immediately moves the valve spool 32 leftwardly to its first position blocking the inlet port 21 from the intermediate passage 24 so that the pump 12 again upstrokes to its high pressure displacement position to meet the demands for fluid by the steering circuit 16. It will be readily apparent that once the demand for fluid by the steering circuit 16 is satisfied and the fluid pressure level again reaches the cut-out pressure level, the cycle will be repeated.

The cut-in pressure level can be selectively changed by increasing or decreasing the aggregate thickness of the shims 41. Likewise, the cut-out pressure level can be adjusted by increasing or decreasing the aggregate thickness of the shims 48. Thus, the cut-in and cut-out pressure setting can be individually adjusted to compensate for manufacturing tolerances.

In view of the foregoing, it is readily apparent that the structure of the present invention provides an improved accumulator charging valve which eliminates the high stress contact areas typically found in currently available accumulator charging valves and which provides individual adjustability of the cut-in and cut-out pressure settings. This is accomplished by utilizing a pair of valve spools one of which is used to set the cut-in pressures as determined by the preload of a spring device and the other valve spool being used to set the cut-out pressure as determined by the preload of another spring device. By adjusting the preload of the spring devices, the cut-in and cut-out pressure levels can be very accurately set.

Other aspects, objects and advantages of this invention can be obtained from a study of the drawings, the disclosure and the appended claims.

I claim:

1. An accumulator charging valve comprising:

a body having an inlet port, an orifice disposed in the inlet port, an outlet port, an intermediate passage, an orifice communicating the intermediate passage with the outlet port, and a control port;

a first valve spool slidably disposed in the body and having a first position establishing communication between the intermediate passage and the outlet port and a second position blocking the intermediate passage from the outlet port;

a second valve spool slidably disposed in the body and having a first position blocking the inlet port from the intermediate passage and a second position establishing communication between the inlet port and the intermediate passage;

a first spring device resiliently biasing the first spool to the first position and having a predetermined preload thereon when the first valve spool is at the first position;

a second spring device resiliently biasing the second valve spool to its first position and having a predetermined preload thereon when the second valve spool is at the first position;

first piston means for moving the first valve spool to its second position when the fluid pressure in the control port reaches a first predetermined level;

second piston means for moving the second valve spool to its second position when the fluid pressure in the control port reaches a second predetermined level which is higher than the first predetermined pressure level; and an actuating chamber defined at one end of the second valve spool and being in continuous communication with the intermediate passage.

2. The accumulator charging valve of claim 1 wherein each of the first and second valve spools has a annular flange connected thereto and abutting the body at the first position of the valve spools.

3. The accumulator charging valve of claim 2 wherein each of the first and second spring devices are disposed between the flanges and the body.

4. The accumulator charging valve of claim 3 wherein each of the first and second spring devices include at least one spring and at least one shim to establish the preload on the spring.

5. The accumulator charging valve of claim 1 wherein the preload on the second spring device is greater than the preload on the first spring device, and each of the first and second piston means includes a piston with the pistons having an equal diameter.

6. The accumulator charging valve of claim 5 wherein each of the first and second spring devices includes a spring chamber in communication with the outlet port and including an orifice disposed between the spring chamber of the first spring device and the outlet port.

7. The accumulator charging valve of claim 6 in combination with a closed center hydraulic system including a variable displacement pump having a displacement controller, a supply conduit connecting the pump with the inlet port upstream of the orifice disposed therein, a signal line communicating the displacement controller with the inlet port downstream of the orifice disposed in the inlet port.

8. The accumulator charging valve of claim 7 wherein the hydraulic system includes a check valve disposed in the supply conduit, an accumulator connected to the supply conduit downstream of the check valve, and a control line communicating the supply conduit downstream of the check valve to the first and second piston means.

* * * * *